US011654696B2

(12) United States Patent
Sakai

(10) Patent No.: US 11,654,696 B2
(45) Date of Patent: May 23, 2023

(54) PRINTING APPARATUS

(71) Applicant: SEIKO EPSON CORPORATION, Tokyo (JP)

(72) Inventor: Toshifumi Sakai, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 37 days.

(21) Appl. No.: 17/324,143

(22) Filed: May 19, 2021

(65) Prior Publication Data

US 2021/0362527 A1 Nov. 25, 2021

(30) Foreign Application Priority Data

May 21, 2020 (JP) ..... JP2020-088717

(51) Int. Cl.
*B41J 3/36* (2006.01)
*B41J 29/393* (2006.01)

(52) U.S. Cl.
CPC ..... *B41J 3/36* (2013.01); *B41J 2029/3932* (2013.01)

(58) Field of Classification Search
CPC ..... B41J 3/36; B41J 2029/3932
See application file for complete search history.

(56) References Cited

U.S. PATENT DOCUMENTS

2009/0032560 A1* 2/2009 Strandberg ..... A45F 3/14 224/267
2018/0170080 A1 6/2018 Suzuki
2018/0250947 A1 9/2018 Nakata et al.
2019/0389238 A1 12/2019 Nakamura et al.
2021/0276341 A1* 9/2021 Osanai ..... B41J 29/023

FOREIGN PATENT DOCUMENTS

CN 108215519 A 6/2018
JP 2018-144338 A 9/2018
JP 2019-217732 A 12/2019
JP 2020-040278 A 3/2020

* cited by examiner

*Primary Examiner* — Julian D Huffman
(74) *Attorney, Agent, or Firm* — Global IP Counselors, LLP

(57) ABSTRACT

A printing apparatus includes a battery housing section that houses a battery, a head placement section where a printing head that performs printing on the medium is placed, and a movement measurement section that measures the movement of the printing apparatus relative to the medium, and the battery housing section, the head placement section, and the movement measurement section are arranged in the order of the battery housing section, the head placement section, and the movement measurement section.

9 Claims, 14 Drawing Sheets

PRINTING APPARATUS

The present application is based on, and claims priority from JP Application Serial Number 2020-088717, filed May 21, 202, the disclosure of which is hereby incorporated by reference herein in its entirety.

BACKGROUND

1. Technical Field

The present disclosure relates to a printing apparatus that performs printing on a medium while being manually moved relative to the medium.

2. Related Art

There has been a known handy mobile printer (hereinafter, referred to as "handy printer") that performs printing on a medium while being manually moved relative to the medium, as disclosed in JP-A-2019-217732 and JP-A-2020-040278. The handy printer includes a battery, a position detection sensor, and an opening in which a printing head is placed. The battery, the position detection sensor, and the opening are arranged in the order of the battery, the position detection sensor, and the opening.

In the handy printer of related art, since the position detection sensor is interposed between the opening, where the printing head is disposed, and the battery, which is a heavy object, the barycenter of the handy printer is located in a position away from the printing head. The handy printer of related art is therefore problematic in that the printing head is easily shifted when the user manually moves the handy printer relative to the medium.

SUMMARY

A printing apparatus according to an aspect of the present disclosure is a printing apparatus that performs printing on a medium while being manually moved relative to the medium, the printing apparatus including a battery housing section that houses a battery, a head placement section where a printing head that performs printing on the medium is placed, and a movement measurement section that optically measures the movement of the printing apparatus relative to the medium, and the battery housing section, the head placement section, and the movement measurement section are arranged in an order of the battery housing section, the head placement section, and the movement measurement section.

A printing apparatus according to another aspect of the present disclosure is a printing apparatus that performs printing on a medium while being manually moved relative to the medium, the printing apparatus including a head placement section where a printing head that performs printing on the medium is placed and a movement measurement section that optically measures the movement of the printing apparatus relative to the medium, and when the printing apparatus is projected onto the medium in a posture in which the printing apparatus is capable of performing printing on the medium, a first barycenter distance between an apparatus barycenter that is a barycenter of the printing apparatus and the printing head is shorter than a second barycenter distance between the apparatus barycenter and the movement measurement section.

DESCRIPTION OF EXEMPLARY EMBODIMENTS

A printing apparatus 101A, which is a first embodiment of the printing apparatus, and a printing apparatus 101B, which is a second embodiment of the printing apparatus, will be described below with reference to the accompanying drawings. When it is not necessary to distinguish the printing apparatus 101A according to the first embodiment and the printing apparatus 101B according to the second embodiment from each other, they are simply referred to as a "printing apparatus 101". The following description will be made by using directions defined in an XYZ orthogonal coordinate system shown in each figure, but the directions are for convenience of the description only and are not at all intended to limit the following embodiments.

Printing System

Figure 1:
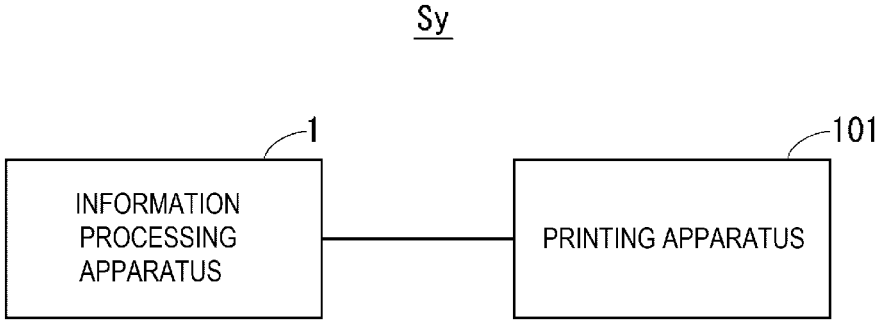
FIG. 1 is a block diagram showing a printing system.

A printing system Sy includes an information processing apparatus 1 and the printing apparatus 101, as shown in FIG. 1. The information processing apparatus 1 and the printing apparatus 101 are communicably connected to each other in a wired or wireless manner.

The information processing apparatus 1 transmits a print job to the printing apparatus 101. The information processing apparatus 1 can, for example, be a smartphone, a tablet terminal, or a personal computer.

Figure 2:
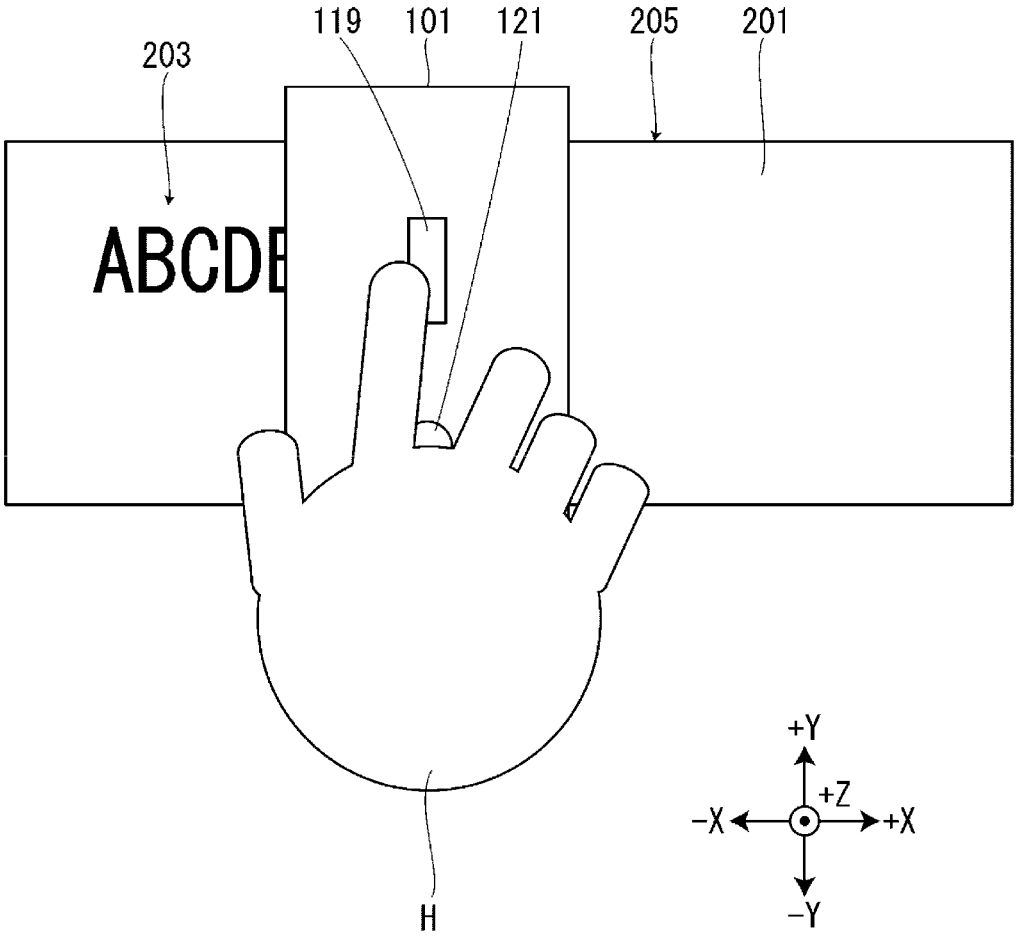
FIG. 2 shows printed matter formed of a medium on which a print image has been printed by a printing apparatus.

The printing apparatus 101 is what is called a handy printer and prints, while being manually moved relative to a medium 201, a print image 203 on the medium 201 based on the print job received from the information processing apparatus 1, as shown in FIG. 2. That is, the printing apparatus 101 produces printed matter 205, which is the medium 201 on which the print image 203 has been printed. The printing apparatus 101 prints the print image 203 on the medium 201 by discharging ink onto the medium 201 based on an inkjet method while the printing apparatus 101 is manually moved relative to the medium 201. The medium 201 is not limited to a print sheet and can, for example, be an envelope, a postal card, a business card, a corrugated sheet, a notepad, a CD (compact disc), and a wooden plate.

Ink Cartridge

Figure 3:
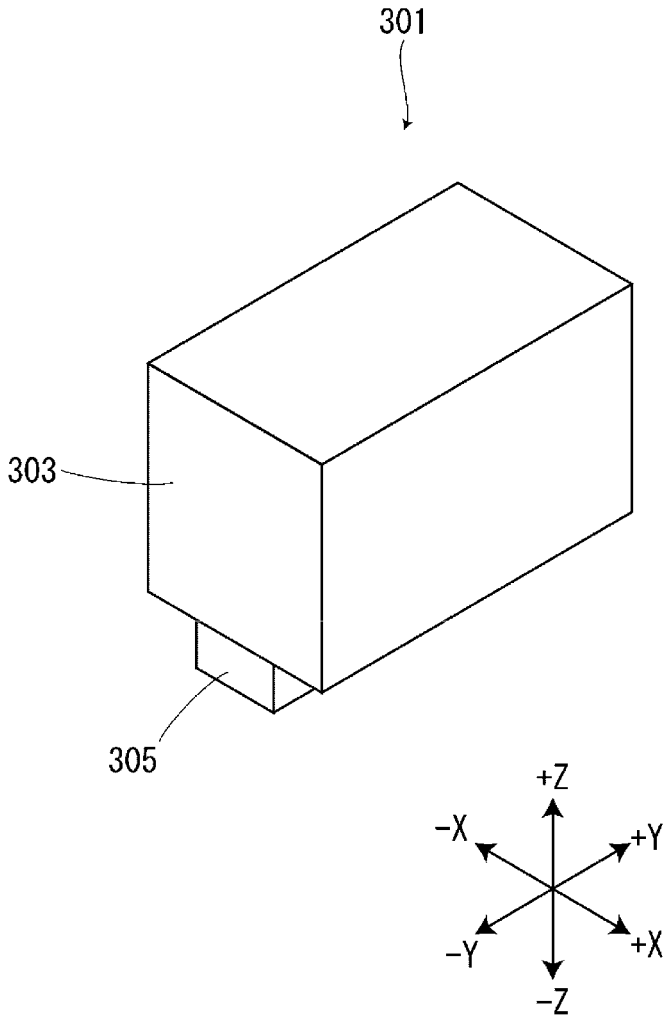
FIG. 3 is a perspective view of an ink cartridge.

An ink cartridge 301 includes an ink tank 303 and a printing head 305, as shown in FIG. 3. The ink cartridge 301 is detachably loaded into the printing apparatus 101 (see FIG. 5).

The ink tank 303 is formed in a substantially-box-like shape. The ink tank 303 stores the ink. The printing head 305 is formed in a substantially-box-like shape smaller than that of the ink tank 303 and is provided on a surface of the ink tank 303 that is the surface facing the negative side of the direction Z at an end portion facing the negative side of the direction Y.

The printing head 305 is an inkjet head including a plurality of nozzles 307 (see FIG. 7) and prints the print image 203 on the medium 201 by discharging the ink supplied from the ink tank 303 via the plurality of nozzles 307.

Printing Apparatus According to First Embodiment

The printing apparatus 101A according to the first embodiment will be described with reference to FIGS. 4 to 10. The printing apparatus 101A is formed in a substantially-box-like shape. The printing apparatus 101A includes a first enclosure 103 and a second enclosure 105. The first enclosure 103 is so connected to an end portion of the second enclosure 105 that is the end portion facing the negative side of the direction Y as to be pivotable via a connection mechanism 107 provided at an end portion of the first enclosure 103 that is the end portion facing the negative side of the direction Y. A hinge can, for example, be used as the connection mechanism 107. The first enclosure 103 is pivotable between a blocking position (see FIG. 5) where the first enclosure 103 blocks a cartridge loading section 109 provided in the second enclosure 105 and an unblocking position (see FIG. 6) where the first enclosure 103 unblocks the cartridge loading section 109. To replace the ink cartridge 301, a user causes the first enclosure 103 to pivot to block and unblock the cartridge loading section 109.

The first enclosure 103 includes a first extending section 111, which extends in the direction Y in the blocking position, and a second extending section 113, which extends in the direction Z in the blocking position. When the first enclosure 103 is caused to pivot to the blocking position, the first extending section 111 blocks a surface of the second enclosure 105 that is the surface facing the positive side of the direction Z, and the second extending section 113 approaches a surface of the second enclosure 105 that is the surface facing the negative side of the direction Y (see FIG. 5). When the first enclosure 103 is caused to pivot to the unblocking position, the first extending section 111 unblocks a surface of the second enclosure 105 that is the surface facing the positive side of the direction Z, and the second extending section 113 moves away from a surface of the second enclosure 105 that is the surface facing the negative side of the direction Y (see FIG. 6).

A first engaging section 115 is provided at an end portion of the first extending section 111 that is an end portion facing the positive side of the direction Y. The first engaging section 115 engages with a second engaging section 117 provided in the second enclosure 105 when the first enclosure 103 is caused to pivot to the blocking position. The first enclosure 103 is thus locked in the blocking position. When the user disengages the first engaging section 115 from the second engaging section 117, the first enclosure 103 is pivotable from the blocking position to the unblocking position.

Figure 4:
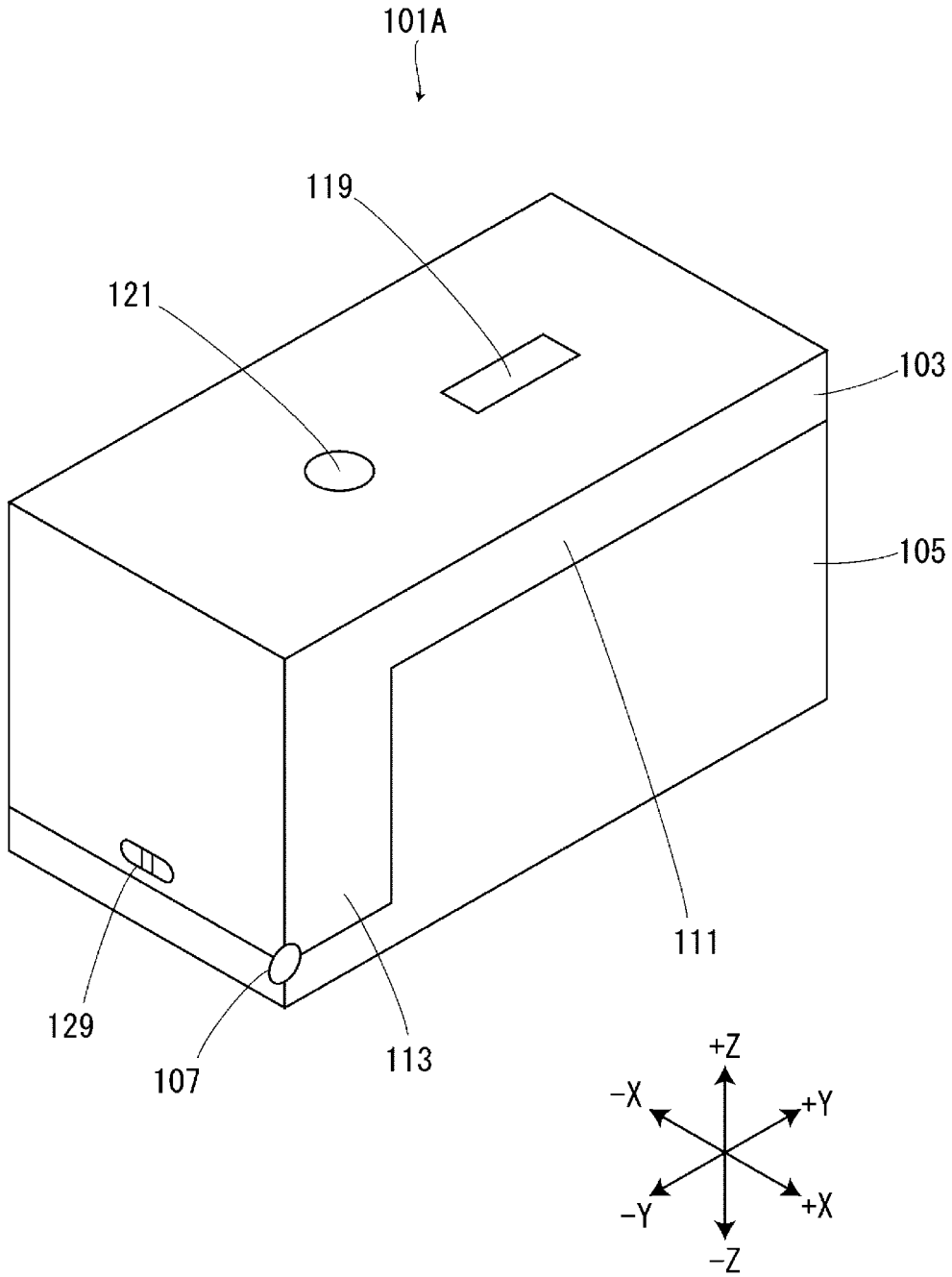
FIG. 4 is a perspective view of the printing apparatus according to a first embodiment.

A printing button 119 and a power button 121 are provided at a surface of the first extending section 111 that is the surface facing the positive side of the direction Z (see FIG. 4). The printing button 119 accepts a printing start instruction from the user. The user can cause the printing apparatus 101A to print the print image 203 (see FIG. 2) by placing the printing apparatus 101A on the medium 201, pressing the printing button 119, and then moving the grasped printing apparatus 101A along the surface of the medium 201. The power button 121 accepts a power ON/OFF switching instruction from the user.

A strap hole 129 is provided in a surface of the second extending section 113 that is the surface facing the negative side of the direction Y (see FIG. 4). A strap 135 (see FIG. 9) is attachable to the strap hole 129. The user can carry the printing apparatus 101A with the printing apparatus 101A hung via the strap 135 attached to the strap hole 129. The strap hole 129 may instead be provided in a surface of the second enclosure 105 that is the surface facing the negative side of the direction Y.

Figure 5:
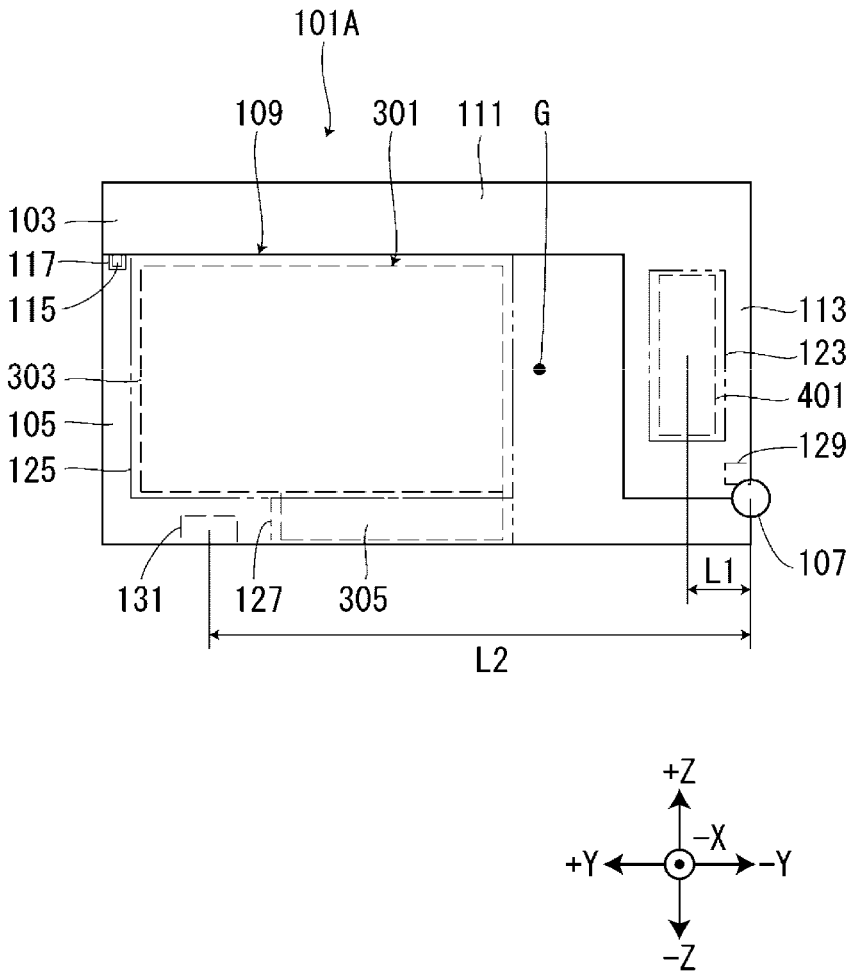
FIG. 5 shows the printing apparatus according to the first embodiment viewed from the negative side of a direction X with a first enclosure located in a blocking position.
Figure 6:
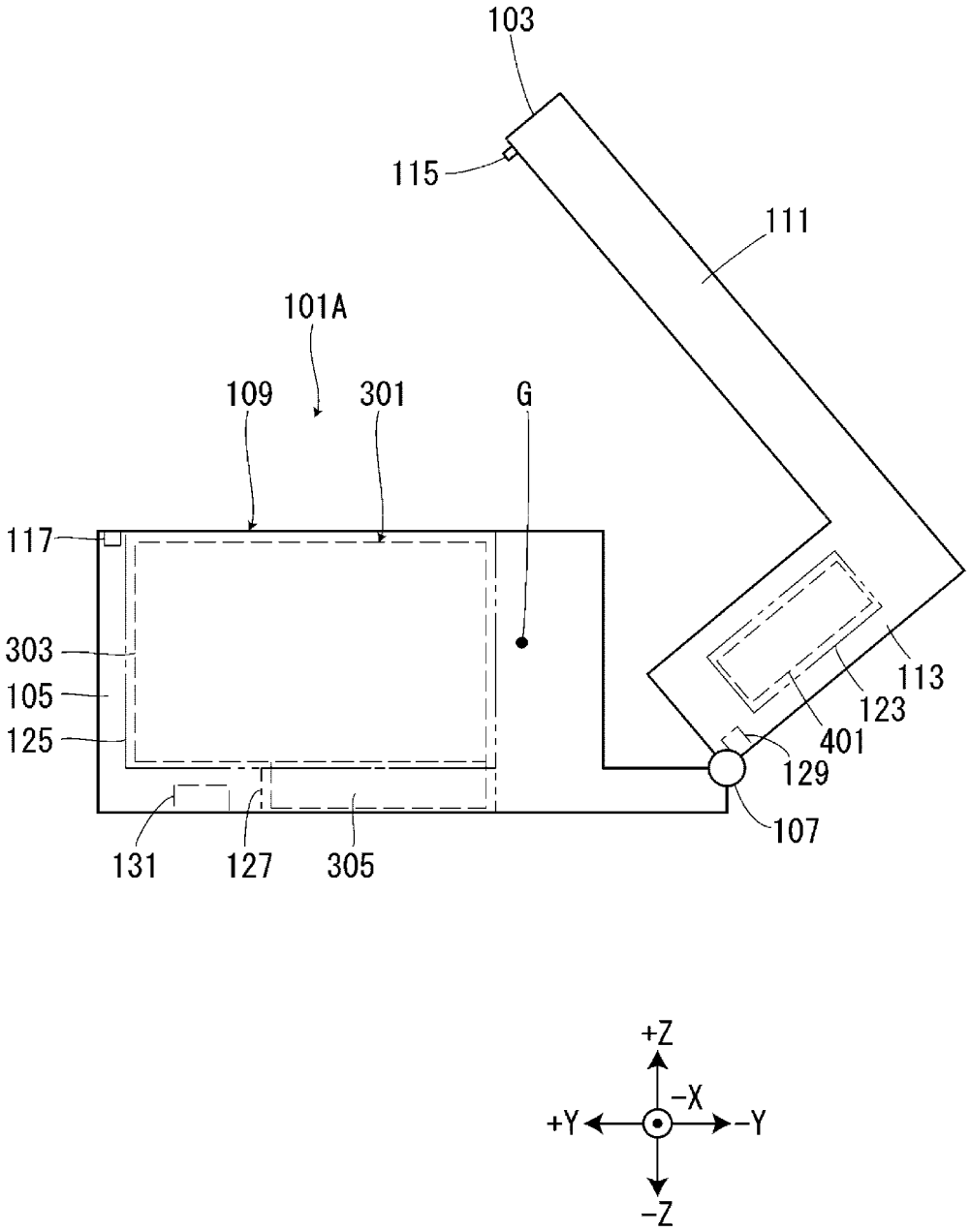
FIG. 6 shows the printing apparatus according to the first embodiment viewed from the negative side of the direction X with the first enclosure located in an unblocking position.

A battery housing section 123 is provided in the second extending section 113, as shown in FIGS. 5 and 6. The battery housing section 123 houses a battery 401. The battery 401 supplies each portion of the printing apparatus 101A with electric power. The battery 401 is housed in the battery housing section 123 in advance at the time of shipment of the printing apparatus 101A. Coupling the printing apparatus 101A, for example, to a commercial power source via a cable allows the battery 401 to be charged while being housed in the battery housing section 123.

The second enclosure 105 is formed in a substantially-box-like shape that is open in the direction +Z. The second enclosure 105 is provided with the cartridge loading section 109. The ink cartridge 301 is detachably loaded in the direction +Z into the cartridge loading section 109.

The cartridge loading section 109 includes a tank placement section 125 and a head placement section 127. The tank placement section 125 is a substantially-box-shaped space that is open in the direction +Z. When the ink cartridge 301 is loaded into the cartridge loading section 109, the ink tank 303 is placed in the tank placement section 125. The head placement section 127 is a substantially-box-shaped space smaller than the tank placement section 125 and is so provided as to be shifted from the tank placement section 125 in the direction −Z. An end of the head placement section 127 that is the end facing the negative side of the direction Z is open toward a surface of the second enclosure 105 that is the surface facing the negative side of the direction Z (see FIG. 7). When the ink cartridge 301 is loaded into the cartridge loading section 109, the printing head 305 is placed in the head placement section 127.

The second engaging section 117 is provided at an end portion of the second enclosure 105 that is the end portion facing the positive side of the direction Y. The second engaging section 117 engages with the first engaging section 115 provided in the first enclosure 103 when the first enclosure 103 is caused to pivot to the blocking position, as described above.

Figure 7:
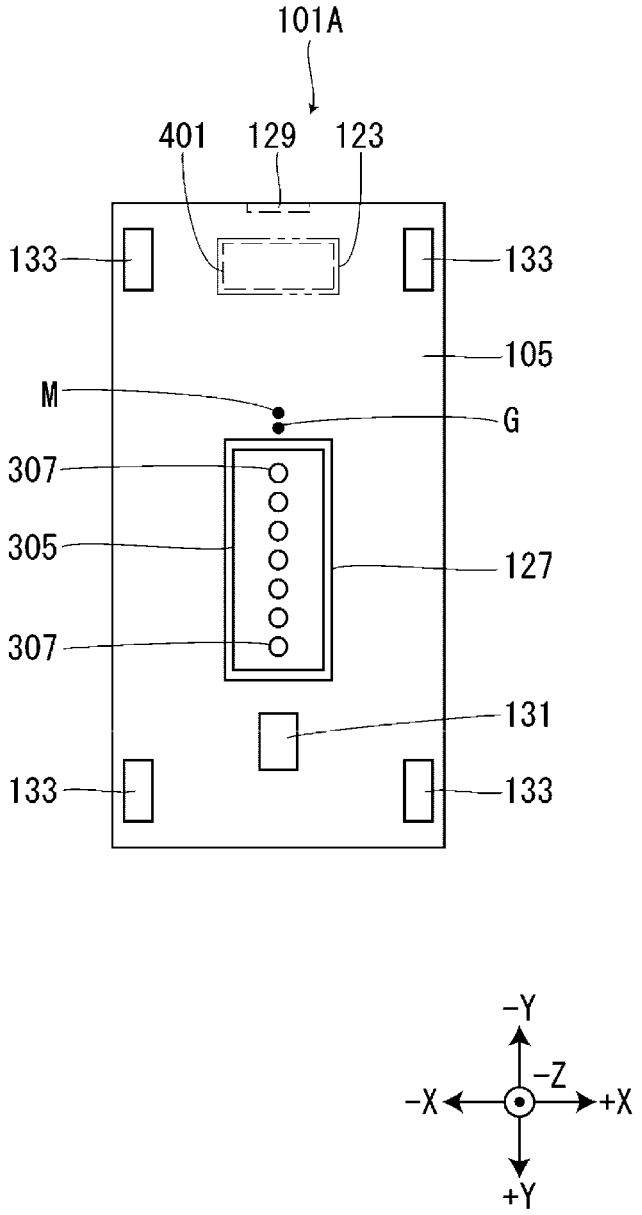
FIG. 7 shows the printing apparatus according to the first embodiment viewed from the negative side of a direction Z.

A movement measurement section 131 and a plurality of rollers 133 are provided at a surface of the second enclosure 105 that is the surface facing the negative side of the direction Z, in addition to the printing head 305 disposed in the head placement section 127, as shown in FIG. 7.

The movement measurement section 131 optically measures the movement of the printing apparatus 101A moved by the user on the medium 201. Measuring the movement of the printing apparatus 101A means measuring the movement direction and the movement distance of the printing apparatus 101A. The movement measurement section 131 includes, for example, a light source, such as an LED (light emitting diode), and an image sensor, and can measure the movement relative to the medium 201 based on a change in an image of the medium 201 outputted by the image sensor.

The plurality of rollers 133 are in sliding contact with the medium 201 and rotate to guide the movement of the printing apparatus 101A relative to the medium 201 in the direction X.

When the user moves the printing apparatus 101A relative to the medium 201, the printing apparatus 101A calculates the position of the printing apparatus 101A relative to the medium 201 based on the result of the measurement performed by the movement measurement section 131. The printing apparatus 101A then discharges the ink via the plurality of nozzles 307 at a timing corresponding to the relative position based on the result of the measurement performed by the movement measurement section 131. The printing apparatus 101A can thus print the print image 203 in an appropriate position on the medium 201 irrespective of the speed at which the user moves the printing apparatus 101A.

When the printing apparatus 101A is viewed in the direction −Z, the battery housing section 123, the head placement section 127, and the movement measurement section 131 are sequentially arranged in the direction −Y in the order of the battery housing section 123, the head placement section 127, and the movement measurement section 131, as shown in FIG. 7. That is, the battery 401, which is a heavy object, and the printing head 305 are located closer to each other than in the related art, in which the movement measurement section 131 is interposed between the head placement section 127, in which the printing head 305 is disposed, and the battery housing section 123, which houses the battery 401. Therefore, when the user manually moves the printing apparatus 101A relative to the medium 201, and even if the printing apparatus 101A is shifted on the medium 201, the distance between the barycenter of the printing apparatus 101, which is the center of rotation thereof, and the printing head 305 is short, whereby the amount of shift of the printing head 305 can be reduced. The printing apparatus 101A can therefore print the print image 203 on the medium 201 with higher precision than in the related art.

Further, an apparatus barycenter G, which is the barycenter of the printing apparatus 101A, is shifted toward the head placement section 127 from a battery-head intermediate position M, which is an intermediated position between the battery housing section 123 and the head placement section 127 in the direction Y, in which the battery housing section 123, the head placement section 127, and the movement measurement section 131 are arranged. That is, the distance between the apparatus barycenter G and the head placement section 127, where the printing head 305 is disposed, is shorter than the distance between the apparatus barycenter G and the battery housing section 123, which houses the battery 401. Therefore, when the user manually moves the printing apparatus 101A relative to the medium 201, and even if the printing apparatus 101A is shifted on the medium 201, the amount of shift of the printing head 305 can be more effectively reduced because the distance between the vicinity of the apparatus barycenter G, which is the center of rotation of the printing apparatus 101A, and the printing head 305 is short.

The apparatus barycenter G means the barycenter of the printing apparatus 101A at the time of printing. That is, the apparatus barycenter G means the barycenter of the printing apparatus 101A in the state in which the battery 401 is housed in the battery housing section 123 and the ink cartridge 301 is loaded into the cartridge loading section 109. In a case where a member to be removed at the time of printing, such as a cover, is attachable and detachable to and from the printing apparatus 101A, the apparatus barycenter G means the barycenter of the printing apparatus 101A in the state in which the member is removed. Further, the intermediate position between the battery housing section 123 and the head placement section 127 means an intermediate position between the center of the battery housing section 123 and the center of the head placement section 127.

Figure 8:
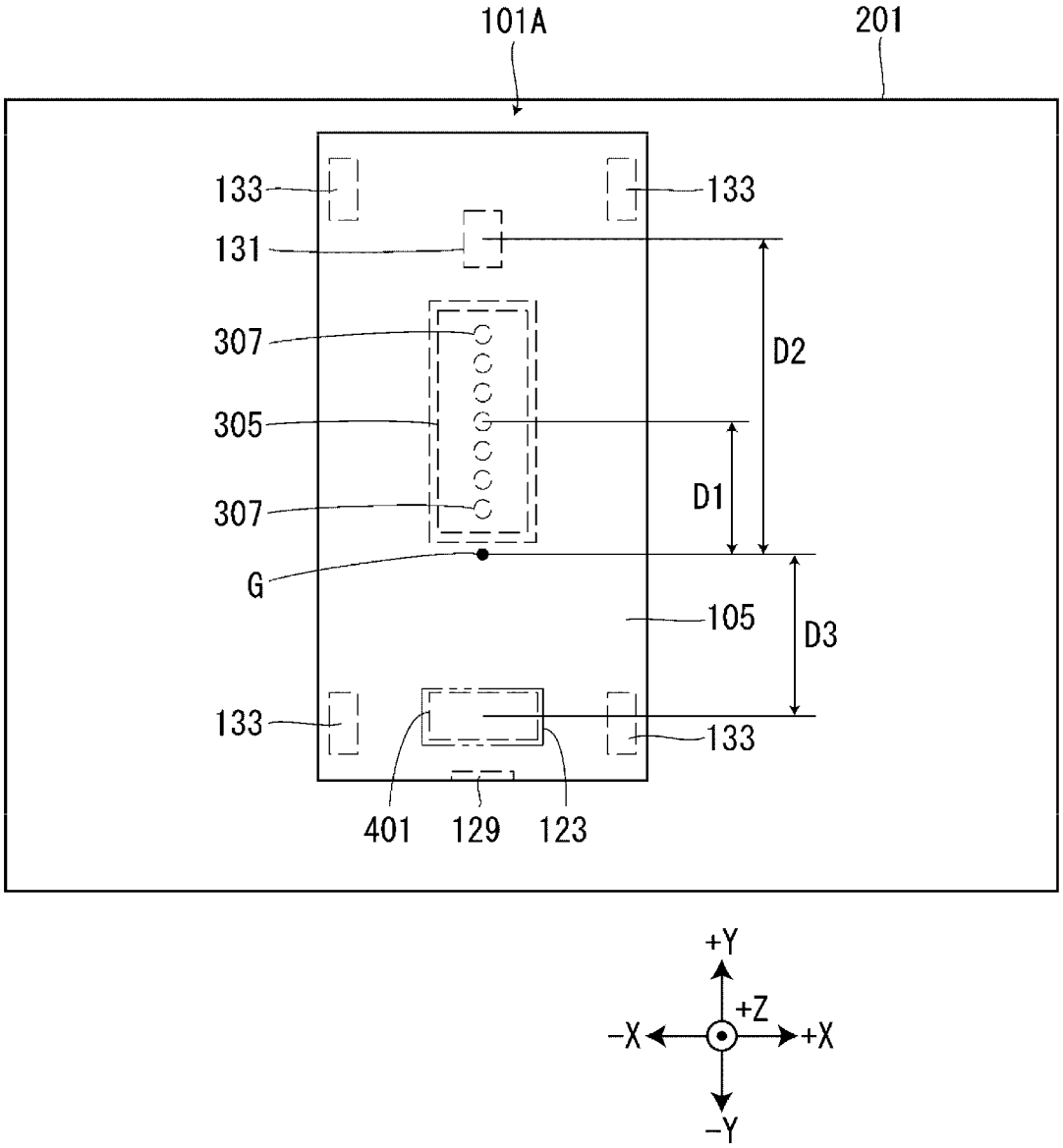
FIG. 8 shows the printing apparatus according to the first embodiment projected onto the medium.

When the printing apparatus 101A is projected on the medium 201 in the state in which the printing head 305 placed in the head placement section 127 and in a posture in which the printing apparatus 101A can perform printing on the medium 201, that is, in a posture in which the printing head 305 faces the medium 201, a first barycenter distance D1 between the apparatus barycenter G and the printing head 305 is shorter than a second barycenter distance D2 between the apparatus barycenter G and the movement measurement section 131, as shown in FIG. 8. The first barycenter distance D1 between the apparatus barycenter G and the printing head 305 means the distance between the apparatus barycenter G and the center of the printing head 305. The second barycenter distance D2 between the apparatus barycenter G and the movement measurement section 131 means the distance between the apparatus barycenter G and the center of the movement measurement section 131. Further, the distance between the apparatus barycenter G and the center of the battery 401 is called a third barycenter distance D3, and the first barycenter distance D1 is shorter than the third barycenter distance D3.

The apparatus barycenter G is located in a position close the printing head 305, as described above. Therefore, when the user manually moves the printing apparatus 101A relative to the medium 201, and even if the printing apparatus 101A is shifted on the medium 201, the amount of shift of the printing head 305 can be reduced because the distance between the vicinity of the apparatus barycenter G, which is the center of rotation of the printing apparatus 101A, and the printing head 305 is short. The printing apparatus 101A can therefore print the print image 203 on the medium 201 with high precision.

When the printing apparatus 101A is viewed in the direction −Z, the strap hole 129, the battery housing section 123, the head placement section 127, and the movement measurement section 131 are arranged in the order of the strap hole 129, the battery housing section 123, the head placement section 127, and the movement measurement section 131, as shown in FIG. 7. That is, since the head arrangement section 127 or the movement measurement section 131 is not interposed between the battery housing section 123, which houses the battery 401, and the strap hole 129, the battery 401 is located in a position close to the strap hole 129.

Figure 9:
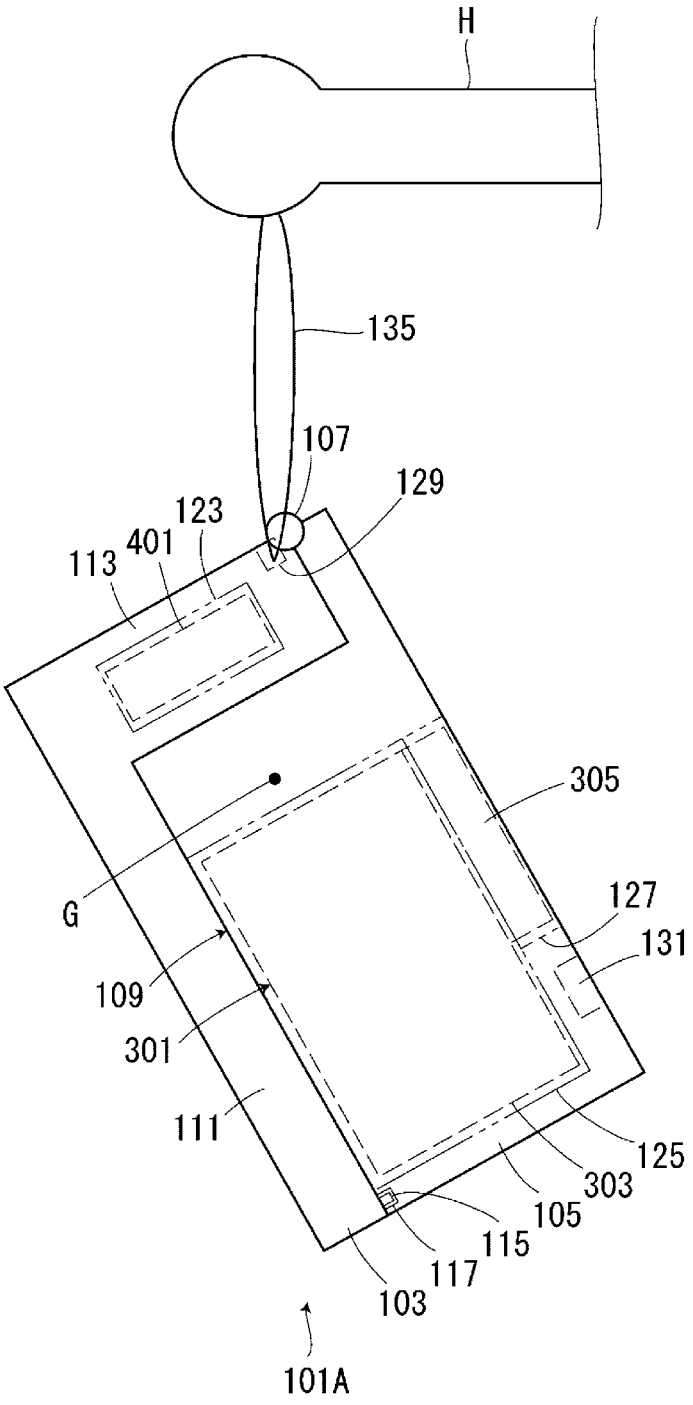
FIG. 9 shows the printing apparatus according to the first embodiment hung via a strap.

Therefore, when the printing apparatus 101A is hung from the user's hand H via the strap 135 attached to the strap hole 129, the distance between the user's hand H, which serves as the center of rotation of the printing apparatus 101A, and the battery 401, which is a heavy object, is short, as shown in FIG. 9, whereby the amount of shift of the printing apparatus 101A can be reduced. The user can therefore stably carry the printing apparatus 101A with the printing apparatus 101A hung from the hand H via the strap 135, as compared with a case where the distance between the user's hand H, which serves as the center of rotation of the printing apparatus 101A, and the battery 401, which is a heavy object, is long.

As shown in FIG. 5, when the first enclosure 103 is located in the blocking position, that is, when the first enclosure 103 blocks the cartridge loading section 109, a first connection distance L1 between the connection mechanism 107 and the battery housing section 123 is shorter than a second connection distance L2 between the connection mechanism 107 and the movement measurement section 131 in the Y direction. That is, the battery 401 housed in the battery housing section 123 is located in a position close to the connection mechanism 107.

Figure 10:
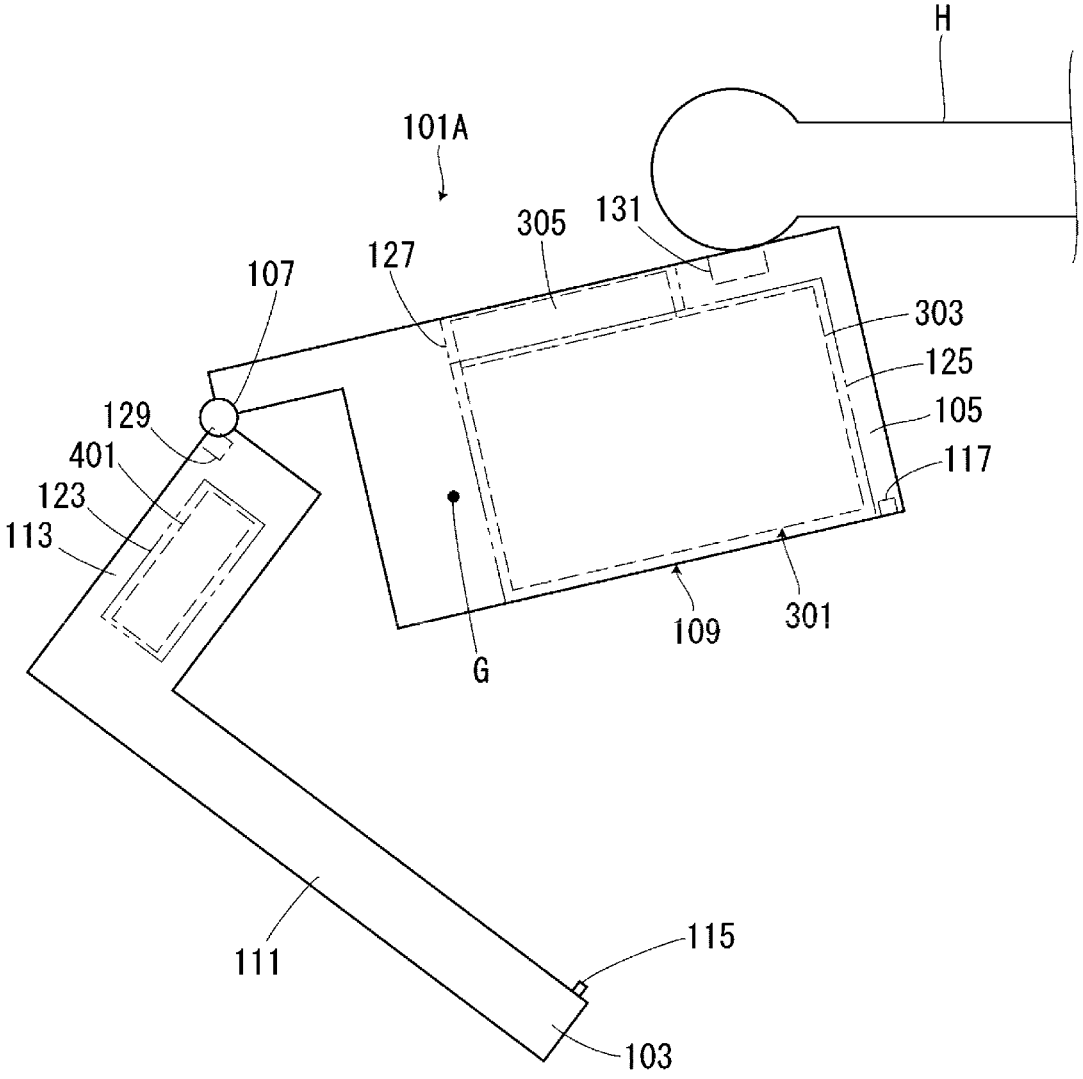
FIG. 10 shows the printing apparatus according to the first embodiment in a state in which the first enclosure is hung from a second enclosure.

Therefore, when the user grips the second enclosure 105 out of the first enclosure 103 and the second enclosure 105 in the state in which the first engaging section 115 and the second engaging section 117 disengage from each other, the distance between the connection mechanism 107, which is the center of rotation of the first enclosure 103 hung from the second enclosure 105, and the battery 401, which is a heavy object, is short, as shown in FIG. 10, whereby the amount of shift of the first enclosure 103 can be reduced. Therefore, to replace the ink cartridge 301, the user can stably hold the printing apparatus 101A even in the state in which the first enclosure 103 is hung from the second enclosure 105.

Printing Apparatus According to Second Embodiment

The printing apparatus 101B according to the second embodiment will be described with reference to FIGS. 11 to 13. Out of the configurations of the printing apparatus 101B, the same configurations as those of the printing apparatus 101A will not be described.

The printing apparatus 101B includes a first enclosure 103 and a second enclosure 105. The second enclosure 105 is pivotably coupled to an end portion of the first enclosure 103 that is an end portion facing the negative side of the direction Y via the connection mechanism 107 provided at an end portion of the second enclosure 105 that is an end portion facing the negative side of the direction Y. The second enclosure 105 is pivotable between a blocking position (see FIG. 11) where the second enclosure 105 blocks the cartridge loading section 109 and an unblocking position (see FIG. 12) where the second enclosure 105 unblocks the cartridge loading section 109 provided in the first enclosure 103.

The first enclosure 103 is formed in a substantially box-like shape having part of the surface in the +Z direction being open. The battery housing section 123 and the cartridge loading section 109 are provided in the first enclosure 103. The battery housing section 123 is so provided as to be shifted from the cartridge loading section 109 in the direction −Y. The first engaging section 115 is provided at an end portion of the first enclosure 103 that is an end portion facing the positive side of the direction Y.

The second enclosure 105 is formed in a substantially-oblong-plate-like shape. The second engaging section 117 is provided at an end portion of the second enclosure 105 that is an end portion facing the positive side of the direction Y. The second engaging section 117 engages with the first engaging section 115 provided in the first enclosure 103 when the second enclosure 105 is caused to pivot to the blocking position. The second enclosure 105 is thus locked in the blocking position. When the user disengages the second engaging section 117 from the first engaging section 115, the second enclosure 105 is pivotable from the blocking position to the unblocking position.

Figure 11:
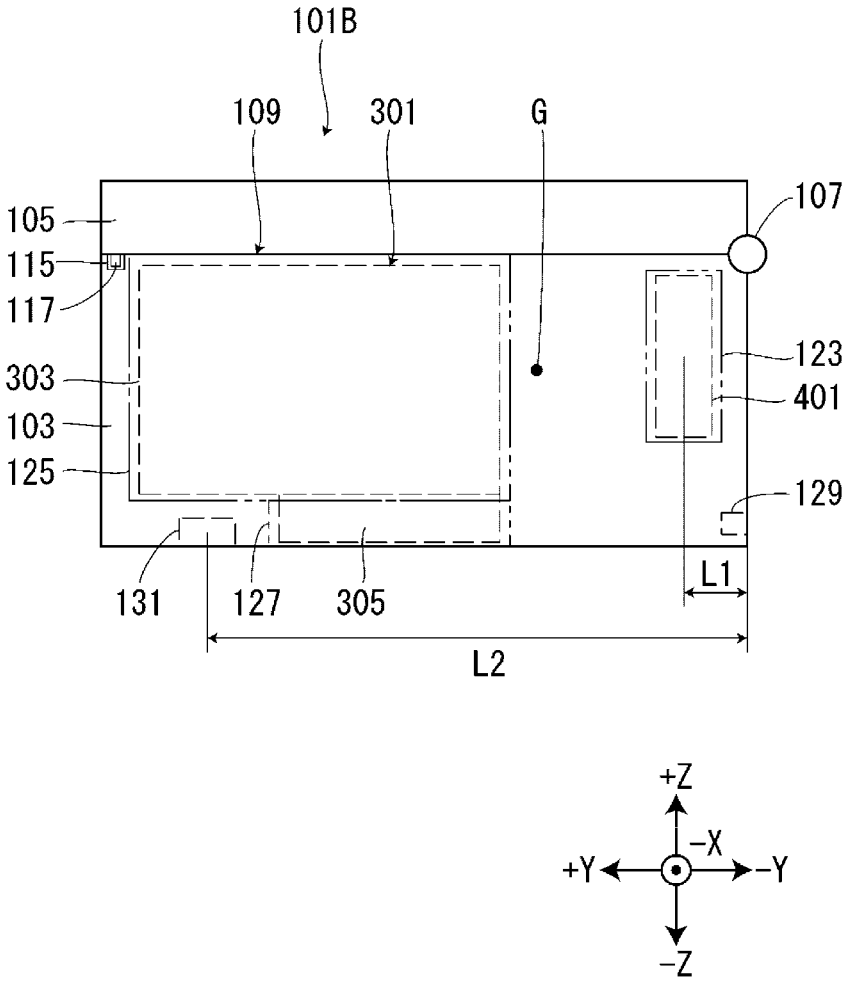
FIG. 11 shows the printing apparatus according to a second embodiment viewed from the side facing the negative side of the direction X when the second enclosure is located in the blocking position.
Figure 12:
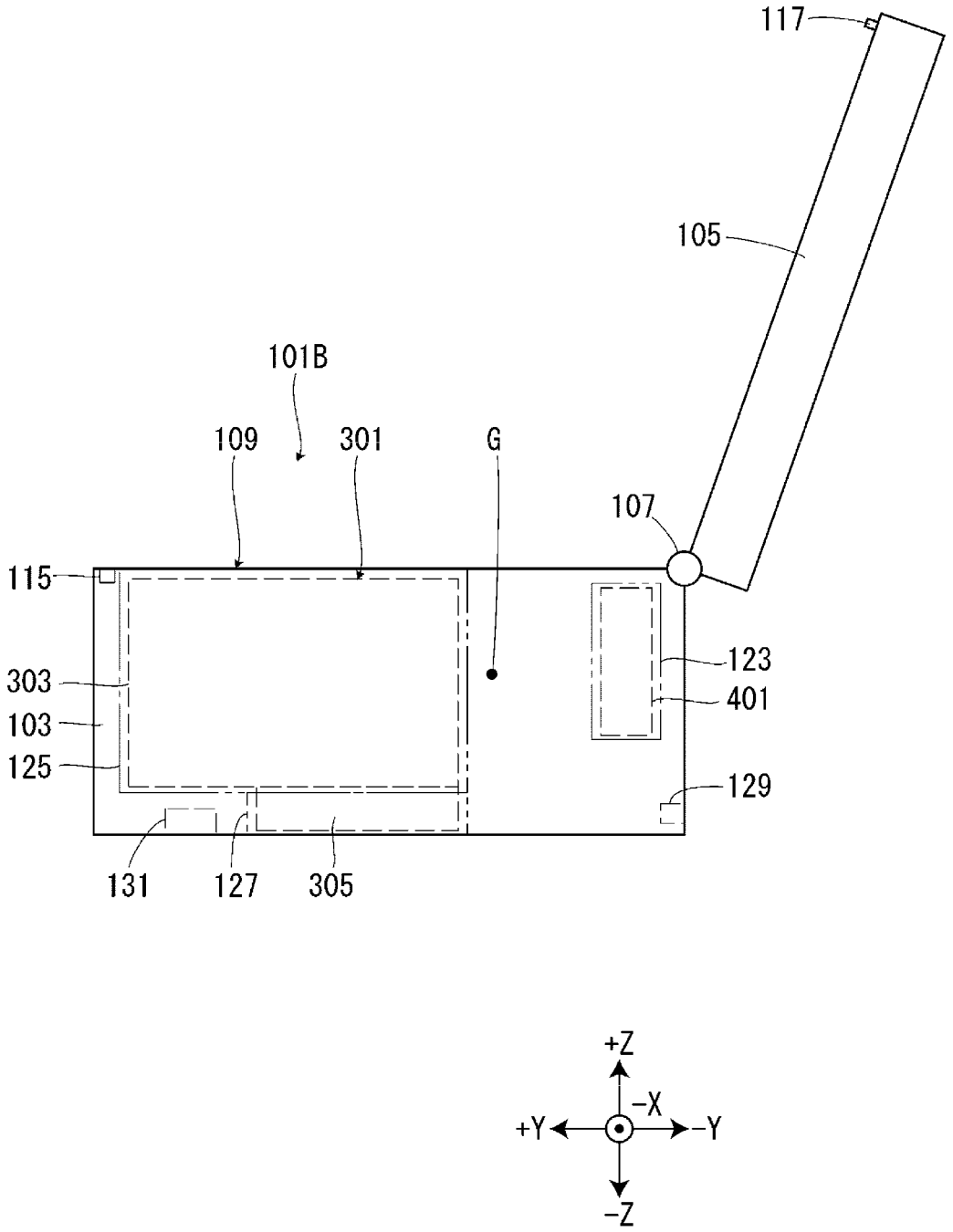
FIG. 12 shows the printing apparatus according to the second embodiment viewed from the side facing the negative side of the direction X when the second enclosure is located in the unblocking position.

When the second enclosure 105 is located in the blocking position, that is, when by the second enclosure 105 blocks the cartridge loading section 109, the first connection distance L1 between the connection mechanism 107 and the battery housing section 123 is shorter than the second connection distance L2 between the connection mechanism 107 and the movement measurement section 131 in the Y direction, as shown in FIG. 11. That is, the battery housing section 123 is located in a position close to the connection mechanism 107.

Figure 13:
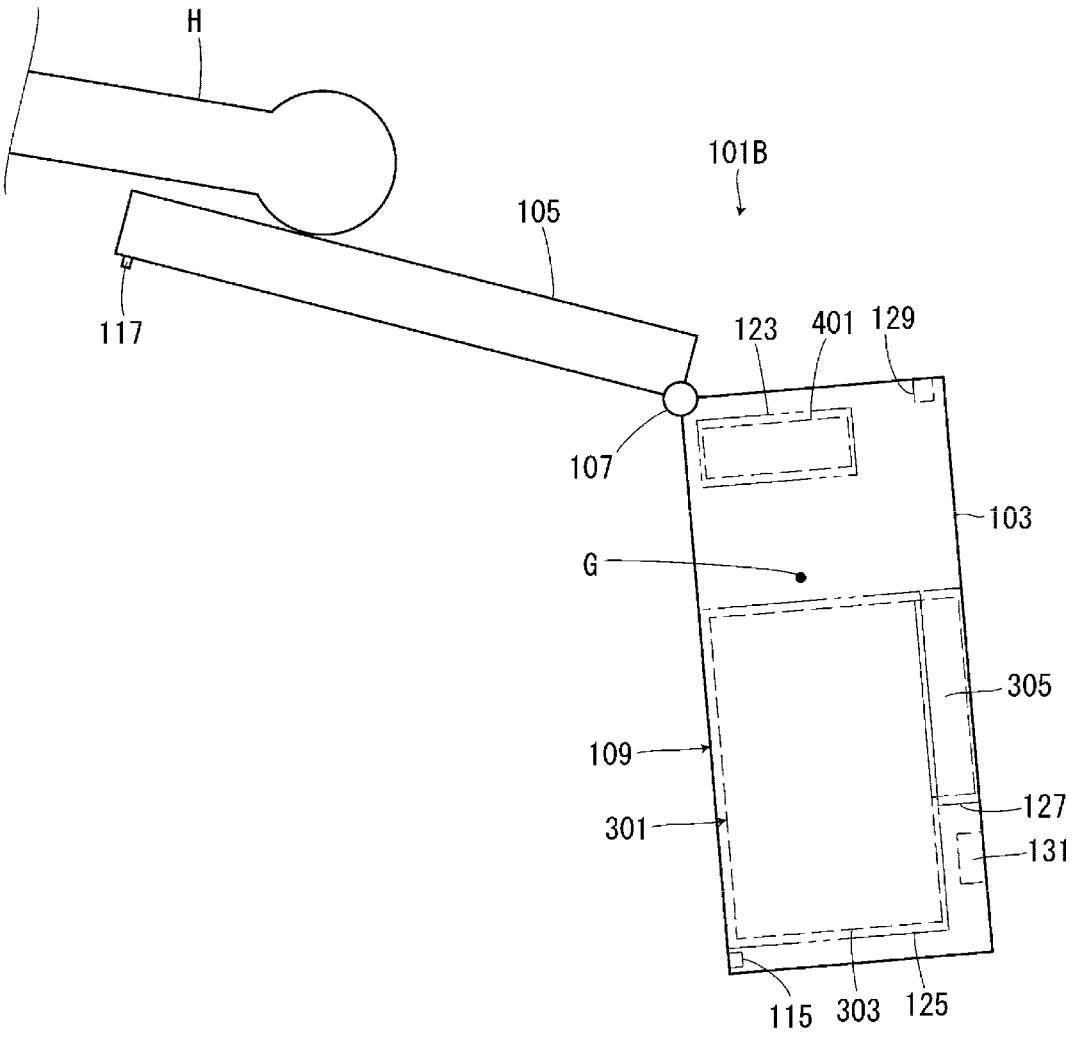
FIG. 13 shows the printing apparatus according to the second embodiment in the state in which the first housing is hung from the second enclosure.

Therefore, when the user grips the second enclosure 105 out of the first enclosure 103 and the second enclosure 105 in the state in which the first engaging section 115 and the second engaging section 117 disengage from each other, the distance between the connection mechanism 107, which serves as the center of rotation of the first enclosure 103 hung from the second enclosure 105, and the battery 401, which is a heavy object, is short, as shown in FIG. 13, whereby the amount of shift of the first enclosure 103 can be reduced. Therefore, to replace the ink cartridge 301, the user can stably hold the printing apparatus 101B even in the state in which the first enclosure 103 is hung from the second enclosure 105.

Other Variations

Needless to say, the present disclosure is not limited to the embodiments described above, and a variety of other configurations can be employed to the extent that they do not depart from the substance of the present disclosure. For example, the embodiments described above can be changed to the following forms in addition to the forms described above. Further, the embodiments and variations may be combined with each other.

Figure 14:
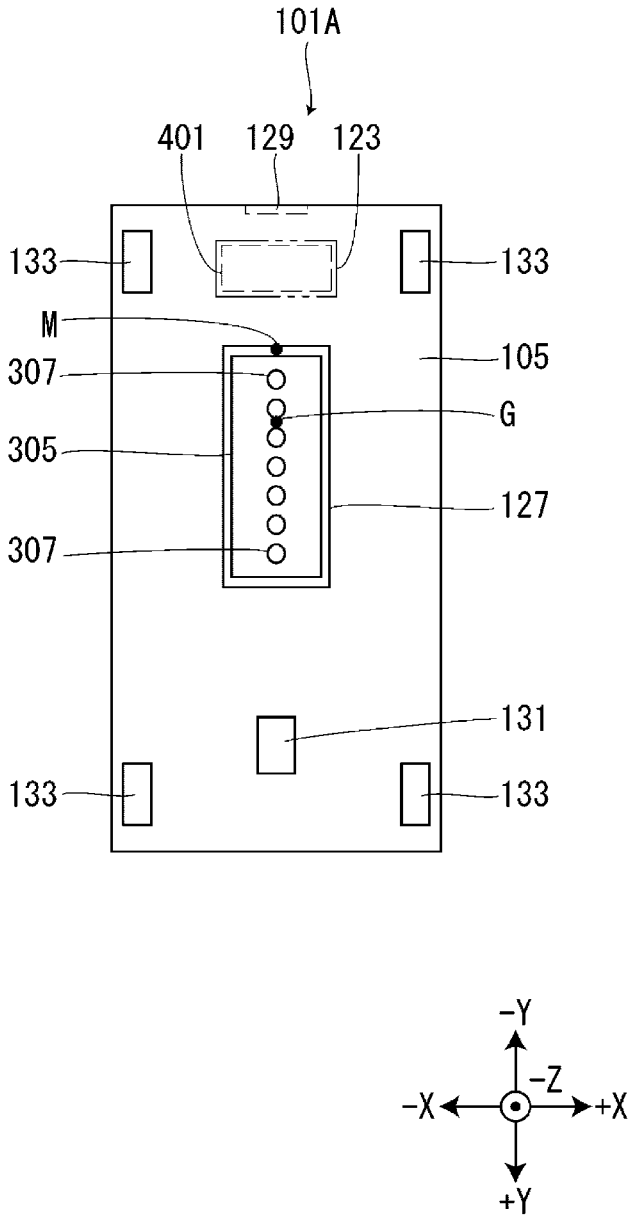
FIG. 14 shows the printing apparatus according to a variation viewed from the negative side of the direction Z.

The apparatus barycenter G does not necessarily deviate from the head placement section 127 in the Y direction and may be located in a position where the apparatus barycenter G overlaps with the head placement section 127 in the Y direction, as shown in FIG. 14. Therefore, when the user manually moves the printing apparatus 101A relative to the medium 201, and even if the printing apparatus 101A is shifted on the medium 201, the distance between the vicinity of the apparatus barycenter G, which is the center of rotation of the printing apparatus 101A, and the printing head 305 is very small, whereby the amount of shift of the printing head 305 can be more effectively reduced.

The battery housing section 123 does not necessarily house the battery 401 at the time of shipment of the printing apparatus 101, and the user may be house the battery 401 purchased separately from the printing apparatus 101. Further, the battery 401 is not necessarily be chargeable while being housed in the battery housing section 123 and may be replaceable with another battery 401. The battery 401 may, of course, be a primary battery.

The printing head 305 is not necessarily provided in the ink cartridge 301 and may be provided in the printing apparatus 101 separately from the ink cartridge 301. That is, the concept in which the printing head 305 is placed in the head placement section 127 is not limited to the configuration in which the ink cartridge 301 is loaded into the cartridge loading section 109 and the printing head 305 is in turn placed in the head placement section 127 and includes a configuration in which the printing head 305 is fixed in advance to the head placement section 127.

In addition to the movement measurement section 131, another movement measurement section may be provided, and the results of the measurement performed by the plurality of movement measurement sections may be combined with one another for more accurate measurement. The other movement measurement section may measure the movement of the printing apparatus 101, for example, by performing inertial measurement. The other movement measurement section, a control substrate that controls the printing apparatus 101, and other components may be appropriately disposed in positions where the mechanism described above is not present.

The connection mechanism 107 does not necessarily have the structure that only rotates like a hinge and may be a mechanism that both rotates and slides.

The printing head 305 is not limited to an inkjet head, and may, for example, be a thermal head that performs printing based on a heat transfer method.

Additional Remarks

The printing apparatus will be additionally described below.

The printing apparatus is a printing apparatus that performs printing on a medium while being manually moved relative to the medium and includes a battery housing section that houses a battery, a head placement section where a printing head that performs printing on the medium is placed, and a movement measurement section that optically measures the movement of the printing apparatus relative to the medium, and the battery housing section, the head placement section, and the movement measurement section are arranged in the order of the battery housing section, the head placement section, and the movement measurement section.

According to the configuration described above, since the movement measurement section is not interposed between the head placement section, where the printing head is placed, and the battery housing section, which houses the battery, the battery, which is a heavy object, is located in a position close to the printing head. Therefore, when the user manually moves the printing apparatus relative to the medium, and even if the printing apparatus is shifted on the medium, the distance between the vicinity of the battery, which is the center of rotation of the printing apparatus, and the printing head is short, whereby the amount of shift of the printing head can be reduced.

In this case, it is preferable that the apparatus barycenter, which is the barycenter of the printing apparatus, is shifted toward the head placement section from an intermediate position between the battery housing section and the head placement section in a first direction in which the battery housing section, the head placement section, and the movement measurement section are arranged.

According to the configuration described above, the distance between the apparatus barycenter and the head placement section, where the printing head is placed, is shorter than the distance between the apparatus barycenter and the battery housing section, which houses the battery. Therefore, when the user manually moves the printing apparatus relative to the medium, and even if the printing apparatus is shifted on the medium, the distance between the vicinity of the apparatus barycenter, which is the center of rotation of the printing apparatus, and the printing head is short, whereby the amount of shift of the printing head can be effectively reduced.

The direction Y is an example of the "first direction."

In this case, it is preferable that the apparatus barycenter is located in a position where the apparatus barycenter overlaps with the head placement section in the first direction.

According to the configuration described above, when the user manually moves the printing apparatus relative to the medium, and even if the printing apparatus is shifted on the medium, the distance between the vicinity of the apparatus barycenter, which is the center of rotation of the printing apparatus, and the printing head is very small, whereby the amount of shift of the printing head can be more effectively reduced.

In this case, it is preferable that the printing apparatus further includes a strap hole to which a strap is attached, and that the strap hole, the battery housing section, the head placement section, and the movement measurement section are arranged in the order of the strap hole, the battery housing section, the head placement section, and the movement measurement section.

According to the configuration described above, since the head placement section or the movement measurement section is not interposed between the battery housing section, which houses the battery, and the strap hole, the battery is located in a position close to the strap hole. Therefore, when the printing apparatus is hung from the user's hand via the strap attached to the strap hole, the distance between the user's hand, which serves as the center of rotation of the printing apparatus, and the battery, which is a heavy object, is short, whereby the amount of shift of the printing apparatus can be reduced.

In this case, it is preferable that the printing apparatus includes a first enclosure provided with the battery housing section, a second enclosure provided with a cartridge loading section into which an ink cartridge is detachably loaded, and a connection mechanism that pivotably couples the first enclosure to the second enclosure in such a way that the first enclosure blocks and unblocks the cartridge loading section, and when the first enclosure is located in a blocking position where the first enclosure blocks the cartridge loading section, a first connection distance between the connection mechanism and the battery housing section is shorter than a second connection distance between the connection mechanism and the movement measurement section in the first direction, in which the battery housing section, the head placement section, and the movement measurement section are arranged.

According to the configuration described above, when the user grips the second enclosure out of the first enclosure and the second enclosure, the distance between the connection mechanism, which is the center of rotation of the first enclosure hung from the second enclosure, and the battery, which is a heavy object, is short, whereby the amount of shift of the first enclosure can be reduced.

In this case, it is preferable that the printing apparatus includes the first housing, which is provided with the battery housing section and the cartridge loading section, into which the ink cartridge is detachably loaded, the second enclosure, and the connection mechanism, which pivotably couples the second enclosure to the first enclosure in such a way that the second enclosure blocks and unblocks the cartridge loading section, and that when the second enclosure is located in a blocking position where the second enclosure blocks the cartridge loading section, the first connection distance between the connection mechanism and the battery housing section is shorter than the second connection distance between the connection mechanism and the movement measurement section in the first direction, in which the battery housing section, the head placement section, and the movement measurement section are arranged.

According to the configuration described above, when the user grips the second enclosure out of the first enclosure and the second enclosure, the distance between the connection mechanism, which is the center of rotation of the first enclosure hung from the second enclosure, and the battery, which is a heavy object, is short, whereby the amount of shift of the first enclosure can be reduced.

In this case, it is preferable that the printing apparatus further includes a strap hole to which a strap is attached, that the strap hole is provided in the first housing, and that when the cartridge loading section is blocked, the strap hole, the battery housing section, the head placement section, and the movement measurement section are arranged in the order of the strap hole, the battery housing section, the head placement section, and the movement measurement section.

According to the configuration described above, since the head placement section or the movement measurement section is not interposed between the battery housing section, which houses the battery, and the strap hole, the battery is located in a position close to the strap hole. Therefore, when the printing apparatus is hung from the user's hand via the strap attached to the strap hole, the distance between the user's hand, which serves as the center of rotation of the printing apparatus, and the battery, which is a heavy object, is short, whereby the amount of shift of the printing apparatus can be reduced.

The printing apparatus is a printing apparatus that performs printing on a medium while being manually moved relative to the medium and includes a head placement section where a printing head that performs printing on the medium is placed and a movement measurement section that optically measures the movement of the printing apparatus relative to the medium, and when the printing apparatus is projected onto the medium in a posture in which the printing apparatus is capable of performing printing on the medium, a first barycenter distance between the apparatus barycenter, which is the barycenter of the printing apparatus, and the printing head is shorter than a second barycenter distance between the apparatus barycenter and the movement measurement section.

According to the configuration described above, the apparatus barycenter is located in a position close to the printing head. Therefore, when the user manually moves the printing apparatus relative to the medium, and even if the printing apparatus is shifted on the medium, the distance between the vicinity of the apparatus barycenter, which is the center of rotation of the printing apparatus, and the printing head is short, whereby the amount of shift of the printing head can be reduced.

What is claimed is:

1. A printing apparatus that performs printing on a medium while being manually moved in a first direction relative to the medium, the printing apparatus comprising:

a battery;

a printing head that performs printing on the medium is placed; and a sensor that measures the movement of the printing apparatus relative to the medium, wherein the battery, the printing head, and the sensor are arranged relative to each other such that the printing head is disposed between the battery and the sensor in a second direction that intersects the first direction.

2. The printing apparatus according to claim 1, wherein a center of gravity of the printing apparatus in a printing state is located closer to the printing head than an intermediate position between the battery and the printing head in the second direction.

3. The printing apparatus according to claim 2, wherein the center of gravity of the printing apparatus is located in a position that overlaps with the printing head in the second direction.

4. The printing apparatus according to claim 1, further comprising a strap hole to which a strap is attached, wherein the strap hole, the battery, the printing head, and the sensor are arranged relative to each other such that the battery is disposed between the strap hole and the printing head.

5. The printing apparatus according to claim 1, further comprising:

a first enclosure that houses the battery;

a second enclosure that houses an ink cartridge that is detachably attachable; and a mechanical connection that pivotably couples the first enclosure to the second enclosure in such a way that the first enclosure covers and uncovers the ink cartridge, wherein when the first enclosure is located in a cover position where the first enclosure covers the ink cartridge, a first connection distance between the mechanical connection and the battery is shorter than a second connection distance between the mechanical connection and the sensor in the second direction.

6. The printing apparatus according to claim 5, further comprising a strap hole to which a strap is attached, wherein the strap hole is provided in the first enclosure, and when the ink cartridge is covered, the strap hole, the battery, the printing head, and the sensor are arranged relative to each other such that the battery is disposed between the strap hole and the printing head placement.

7. The printing apparatus according to claim 1, further comprising:

a first enclosure that houses the battery and an ink cartridge that is detachably attachable, a second enclosure; and a mechanical connection that pivotably couples the second enclosure to the first enclosure in such a way that the second enclosure covers and uncovers the ink cartridge, wherein when the second enclosure is located in a cover position where the second enclosure covers the ink cartridge, a first connection distance between the mechanical connection and the battery is shorter than a second connection distance between the mechanical connection and the sensor in the second direction.

8. A printing apparatus that performs printing on a medium while being manually moved relative to the medium, the printing apparatus comprising:

a printing head that performs printing on the medium; and a sensor that measures the movement of the printing apparatus relative to the medium, wherein when the printing apparatus is projected onto the medium in a posture in which the printing apparatus is capable of performing printing on the medium, a first distance between center of gravity of the printing apparatus in a printing state and the printing head is shorter than a second distance between the center of gravity of the printing apparatus and the sensor.

9. A printing apparatus that performs printing on a medium while being manually moved relative to the medium, the printing apparatus comprising:

a battery; and a printing head that performs printing on the medium, wherein when the printing apparatus is projected onto the medium in a posture in which the printing apparatus is capable of performing printing on the medium, a first distance between a center of gravity of the printing apparatus in a printing state and the printing head is shorter than a third distance between the center of gravity of the printing apparatus and the battery.

* * * * *